US012742126B2

(12) United States Patent
Thiessen et al.

(10) Patent No.: US 12,742,126 B2
(45) Date of Patent: Sep. 22, 2026

(54) METHOD AND APPARATUS FOR A COMBINED TIRE PYROLYZER/GASIFIER AND BIOMASS GASIFIER

(71) Applicants: Randall J. Thiessen, Toledo, IA (US); Lavoy M. Thiessen, Jr., Parker, CO (US)

(72) Inventors: Randall J. Thiessen, Toledo, IA (US); Lavoy M. Thiessen, Jr., Parker, CO (US)

( * ) Notice: Subject to any disclaimer, the term of this patent is extended or adjusted under 35 U.S.C. 154(b) by 0 days.

(21) Appl. No.: 18/194,760

(22) Filed: Apr. 3, 2023

(65) Prior Publication Data

US 2023/0313059 A1 Oct. 5, 2023

Related U.S. Application Data

(60) Provisional application No. 63/362,435, filed on Apr. 4, 2022.

(51) Int. Cl.
*C10J 3/34* (2006.01)
*C10B 53/07* (2006.01)
(Continued)

(52) U.S. Cl.
CPC ..... *C10J 3/86* (2013.01); *C10B 53/07* (2013.01); *C10J 3/34* (2013.01); *C10J 3/721* (2013.01);
(Continued)

(58) Field of Classification Search
CPC ..... C10J 3/86; C10J 3/34; C10J 3/721; C10J 2300/0916; C10J 2300/0976;
(Continued)

(56) References Cited

U.S. PATENT DOCUMENTS 1,762,242 A 6/1930 Rodler
3,587,489 A 6/1971 Demar
(Continued)

FOREIGN PATENT DOCUMENTS

CA 2734315 A1 * 3/2010 ..... C10J 3/34
DE 3642619 A1 6/1988
(Continued)

OTHER PUBLICATIONS

"Biomass Gasification Technology and Utilization," History and Development, [Retrieved on Mar. 19, 2018]. Retrieved from Internet: <URL: http://cturare.tripod.com/his.html>, 2 pages.
(Continued)

*Primary Examiner* — Kaity V Chandler
(74) *Attorney, Agent, or Firm* — McKee, Voorhees & Sease, PLC

(57) ABSTRACT

A gasifier system that combines the use of dirty fuels with clean fuels such as biomass. The heat created produces steam for the co-generation of mechanical power and electricity. The dirty fuels are converted in a gasifier or a pyrolyzer into various useful products that include syngas, heat, and oils. Syngas that is produced by the dirty fuels normally emits pollutants when combusted that require scrubbing. However, when the syngas is combusted into a biomass gasifier the dirty fuel emissions are scrubbed by being reformed into a much cleaner syngas/producer gas. Heat transferred from the dirty fuels gasifier/pyrolyzer syngas increases the efficiency of the clean fuels gasifier that results in increased amounts of steam for electricity/power production. In lieu of producing steam, the syngas from the clean fuel gasifier can be used to fuel an engine for power production. Other outputs from the clean-fuels gasifier include biochar and ash.

20 Claims, 10 Drawing Sheets

(51) Int. Cl.
*C10J 3/72* (2006.01)
*C10J 3/86* (2006.01)
*F02C 3/20* (2006.01)

(52) U.S. Cl.
CPC ..... *C10J 2300/0916* (2013.01); *C10J 2300/0976* (2013.01); *C10J 2300/16* (2013.01); *C10J 2300/1606* (2013.01); *C10J 2300/1675* (2013.01)

(58) Field of Classification Search
CPC ..... C10J 2300/16; C10J 2300/1606; C10J 2300/1675; C10J 3/32; C10J 3/42; C10J 2300/095; C10J 3/26; C10J 2300/0956; C10J 2300/0959; C10J 3/66; C10J 3/84; C10B 53/07; C10K 1/004; C10K 1/32
See application file for complete search history.

(56) References Cited

U.S. PATENT DOCUMENTS 3,741,890 A * 6/1973 Smith et al. ..... F23G 5/30 159/905
3,818,869 A 6/1974 Blaskowski
3,951,616 A 4/1976 Rudolph
3,966,634 A 6/1976 Sacks
3,986,348 A 10/1976 Switzer, Jr.
4,011,059 A 3/1977 Daly et al.
4,385,905 A 5/1983 Tucker
4,453,950 A 6/1984 Fasching
4,478,039 A 10/1984 Horgan
4,497,637 A 2/1985 Purdy et al.
4,498,909 A 2/1985 Milner et al.
4,519,810 A 5/1985 Haas
4,583,992 A 4/1986 Rogers
4,617,182 A 10/1986 Brown et al.
4,659,340 A 4/1987 Weaver
4,672,899 A 6/1987 Kainer
4,764,185 A 8/1988 Mayer
4,918,915 A 4/1990 Pfefferle
5,026,403 A 6/1991 Michel-Kim
5,028,241 A 7/1991 Kooiman et al.
5,089,030 A 2/1992 Michel-Kim
5,226,927 A 7/1993 Rundstrom
5,230,716 A 7/1993 Notestein
5,279,234 A 1/1994 Bender et al.
5,507,141 A 4/1996 Stigsson
5,534,659 A 7/1996 Springer et al.
5,563,803 A 10/1996 Morihara et al.
5,573,559 A 11/1996 Hilliard et al.
5,584,255 A 12/1996 Bishop et al.
5,624,470 A 4/1997 Tanca
5,626,088 A 5/1997 Hiltunen et al.
5,626,638 A 5/1997 Valkanas
5,666,801 A 9/1997 Rohrer
5,837,316 A 11/1998 Fuchita
5,922,090 A 7/1999 Fujimura et al.
5,937,652 A 8/1999 Adbelmalek
5,938,975 A 8/1999 Ennis et al.
6,149,765 A 11/2000 Mansour et al.
6,680,137 B2 1/2004 Paisley
8,505,300 B2 8/2013 Thiessen
8,961,626 B1 * 2/2015 Thiessen ..... F23G 5/46 48/61
10,889,771 B2 * 1/2021 O'Grady ..... F23L 1/00
2002/0088236 A1 7/2002 Arar et al.
2003/0106266 A1 * 6/2003 Bryan ..... C10J 3/54 48/77
2003/0136127 A1 7/2003 Thiessen
2003/0196577 A1 10/2003 Lefcort
2004/0020207 A1 2/2004 Thiessen
2004/0182294 A1 9/2004 Hahn et al.
2006/0180459 A1 8/2006 Bielenberg
2007/0169411 A1 7/2007 Thiessen et al.
2007/0258869 A1 * 11/2007 Tsangaris ..... C10J 3/723 422/186.04
2008/0086945 A1 4/2008 Wunning
2009/0018222 A1 1/2009 Klepper et al.
2009/0060803 A1 3/2009 Schinski
2009/0158658 A1 6/2009 Stadler et al.
2009/0217574 A1 9/2009 Coleman et al.
2012/0174431 A1 7/2012 Cash et al.
2014/0033777 A1 2/2014 Schendel et al.
2014/0228598 A1 8/2014 Patta et al.
2015/0020717 A1 1/2015 Perttila et al.
2015/0239743 A1 * 8/2015 Despen ..... C01B 32/30 502/437
2017/0349847 A1 12/2017 Thiessen et al.
2022/0073829 A1 * 3/2022 Chandran ..... C10J 3/485

FOREIGN PATENT DOCUMENTS

EP 0117765 A2 9/1984
EP 2508271 A2 10/2012
JP 2775851 B2 * 7/1998 ..... F01K 9/003
WO 2009100487 A1 8/2009
WO WO-2016064407 A1 * 4/2016 ..... C10J 3/26

OTHER PUBLICATIONS

"Biomass Gasification Technology and Utilization," Overview of Gasification Technology, Created on Jul. 1997, [Retrieved on Mar. 19, 2018]. Retrieved from Internet: <URL: http://cturare.tripod.com/ove.html>, 2 pages.
"Biomass gasifiers: A viable option," Teriin, [Retrieved on Mar. 19, 2018]. Retrieved from Internet: <URL: https://teriin.org/news/terivsn /issue30/biomass.html>, 4 pages.
"Carbon Adsorbers," Hell Process Equipment, [Retneved on Jan. 25, 2022]. Retneved from Internet: <URL: https://heilprocessequipment.com/products/carbon-adsorbers?GA_network=g&GA_device=c&GA_campaign=11849418455&GA_adgroup=113842631663&GA_target=&GA_placement=&GA_creative=486413463025&GA_extension=&GA_keyword=&GA_loc_physical_ms=9008337&GA_landingpage=https://heilprocessequipment.com/products/carbon-adsorbers&gclid=Cj0KCQjww4-hBhCtARIsAC9gR3Z602x.
Brewer et al., "Characterization of Biochar from Fast Pyrolysis and Gasification Systems," Environmental Progress & Sustainable Energy, Oct. 2009, vol. 28, No. 3, pp. 386-396.
D'Acierno et al., "Sustainable Biochars from carbonization of cellulose filaments and nanocrystals," Bioresource Technology Reports, Dec. 2021, vol. 16, No. 100838, pp. 1-7.
Keller, Maura, "Making Inroads with Tire Pyrolysis," American Recycler News, Inc., Published on Jul. 2017, [Retrieved on Jan. 25, 2022], Retrieved from the Internet: <URL:https://americanrecycler.com/8568759/index.php/news/rubber-recycling/2447-making-inroads-with-tire-pyrolysis>, 4 pages.
Kwiatkowski et al., "Turbulent combustion of biomass syngas," Archives of Mechanics, Nov. 2012, vol. 64, No. 5, op. 511-527.
Muilenberg et al., "Computational Modeling of the Combustion and Gasification Zones in a Downdraft Gasifier (DRAFT)," Proceedings of the ASME 2011 International Mechanical Engineering Congress & Exposition, MECE2011-64009, Nov. 11-17, 2011, Denver, CO, USA, pp. 1-8.
Niessen et al., "Evaluation of Gasification and Novel Thermal Processes for the Treatment of Municipal Solid Waste," National Renewable Energy Laboratory, Aug. 1996, 207 pages.
Office Action in AU2014409609, mailed Mar. 6, 2018, 5 pages.
"Plant Cells Have Chloroplasts and Other Structures Not Present in Animal Cells," Scitable by Nature Education [Retrieved on Mar. 10, 2023]. Retrieved from Internet: <URL: https://www.nature.com/scitable/ebooks/essentials-of-cell-biology-14749010/118240727/>, 3 pages.
Reed et al., "A Survey of Biomass Gasification 2001," Gasifier Projects and Manufacturers Around the World, 2001, 2nd Edition, 221 pages.
Rongpipi et al., "Progress and Opportunities in the Characterization of Cellulose—An Important Regulator of Cell Wall Growth and Mechanics," Frontiers in Plant Science, Mar. 2019, vol. 9, No. 1894, pp. 1-28.

(56) References Cited

OTHER PUBLICATIONS

Shi et al., "Biomass Gasification in a Pilot-Scale Gasifier," Proceedings of the ASME 2014 International Mechanical Engineering Congress & Exposition, IMECE2014-38958, Nov. 14-20, 2014, Montreal, CA, pp. 1-5.
"The Major Types of Industrial Scrubbers," Wermac, [Retrieved on Jan. 25, 2022]. Retrieved from Internet: <URL: www.wermac.org/equipment /scrubbers_part1.html>, 3 pages.
"Tyre Pyrolysis & Gasification Category," Tires, Tyres & More Tires, [Retrieved on Mar. 19, 2018]. Retrieved from Internet: <URL:http://www.tirestyres.com/a/rb8070.html>, 6 pages.
Woodgas: Combustible Gases from Dry Biomass, [Retrieved on Jul. 6, 2017]. Retrieved from Internet: <URL:www.woodgas.com>, 2 pages.
International Search Report and Written Opinion in PCT/US2023/065259, mailed Jul. 10, 2023, 10 pages.

* cited by examiner

METHOD AND APPARATUS FOR A COMBINED TIRE PYROLYZER/GASIFIER AND BIOMASS GASIFIER

CROSS REFERENCE

This application claims priority under 35 U.S.C. § 119 to provisional patent application U.S. Ser. No. 63/362,435 filed Apr. 4, 2022. The provisional patent application is herein incorporated by reference in its entirety.

FIELD OF THE INVENTION

The present invention relates generally to, but is not limited to, an improved combined pyrolyzer and gasifier which cleanses emissions and provides co-generation of power from the burning of waste materials, tires, and/or low-grade coals. More particularly, but not exclusively, the present invention relates to a combined tire pyrolyzer/gasifier and biomass gasifier that utilizes a pyrolizer or updraft gasifier in combination with a biomass gasifier instead of a typical tire combustor/incinerator or stand-alone tire pyrolyzer/gasifier that requires scrubbers to clean the resultant syngas exhaust. Essentially, the biomass gasifier serves as a non-parasitic scrubber for the syngas exhausted from the tire pyrolyzer/gasifier.

BACKGROUND OF THE INVENTION

The background description provided herein gives context for the present disclosure. Work of the presently named inventors, as well as aspects of the description that may not otherwise qualify as prior art at the time of filing, are neither expressly nor impliedly admitted as prior art.

Most clean-burning gasifiers use plant matter, but some can safely dispose of special and/or hazardous materials including plastics, used tires, railroad ties, and medical wastes.

Currently, there are many types of combined steam boiler/combustor and gasifier systems known in the art. Some of these gasification systems use the gasification process as the primary energy generation means. These gasification systems generally take materials, such as wood, coal, charcoal, agricultural residues, energy crops, municipal solid waste or other biomass materials, and gasify them to make a "producer gas" (sometimes referred to as "syngas") used for power or electricity generation. A typical gasification system consists of a gasifier unit, filtering system, and an energy converter.

Steam boiler/combustor units are well-known, though their use as primary energy generation has been questionable for some time, mainly because of the harmful resultant emissions. A steam boiler/combustor creates high pressure steam used for power generation, process steam, or heating. Prior art systems apply steam boiler/combustor units as secondary energy generation means to gain energy and thus increased efficiency from the gases and char produced during the gasification process.

One such method and apparatus for combined steam boiler/combustor and gasifiers is described in U.S. Pat. No. 6,637,206 to Thiessen, herein incorporated by reference in its entirety. There exists a need in the art for an apparatus which improves upon the gasification system described by Thiessen, and even more particularly, for a gasification system that substitutes a pyrolizer or an updraft gasifier for the first combustor/incinerator in Thiessen's previous system.

SUMMARY OF THE INVENTION

Partial combustion of biomass at high temperatures under reduced oxygen conditions can produce gases used to produce liquid fuels such as methanol, combustion for heat, electricity generation, chemical fabrication such as ammonia.

Pyrolysis occurs under low or no presence of oxygen. Ash, char, liquids, and volatile gases (syngas) are produced. Updraft gasifiers produce mostly primary hydrocarbons directly from biomass pyrolysis (10-12 molecular weight). Downdraft gasifiers produce mostly tertiary hydrocarbons (very large hydrocarbons). Cross draft gasifiers produce a mix of secondary and tertiary hydrocarbons (large hydrocarbons).

Gasification occurs at low levels of oxygen, insufficient for combustion. Gasification is sometimes referred to a partial combustion or semi-combustion. Ash, char, and volatile gases (syngas or producer gas) are produced.

Combustion (burning) is generally in an environment that is open to the air and sometimes includes adding pure oxygen to accelerate the process. Ash, char, and $CO_2$ are produced, although, depending upon what is being burned, a significant amount of volatile pollutants (e.g., VOCs—volatile organic compounds) can be released. For example, when tires are burned in the open air, the black smoke is a highly volatile pollutant.

The difference between syngas and producer gas is that syngas is produced in the absence of nitrogen while producer gas is produced using air which is almost 80% nitrogen. However, it is not unusual to see the term syngas used in lieu of producer gas because it tends to immediately imply a gas resulting from gasification instead of something like natural gas or propane. The system disclosed herein uses air and thus producer gas is produced, though with simple modifications to the system, syngas not containing nitrogen can be produced.

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the present invention to improve on or overcome the deficiencies in the art.

It is still yet a further object, feature, and/or advantage of the present invention to recycle. For example, whole, halved or shredded tires can be pyrolyzed in a reactor containing an oxygen-free atmosphere and a heat source. The vapors (synthesis gases) can be burned directly to produce power or condensed into an oily-type liquid, called pyrolysis oil. Both the vapors (syngas) and/or the pyrolysis oil can then be burned in yet another gasifier, such as a downdraft biomass gasifier.

It is still yet a further object, feature, and/or advantage of the present invention to provide a system capable of burning two different types of fuel. Preferably, the primary fuel is a high-energy/high-polluting fuel used to generate a substantial amount of the energy from the system, and a normally larger amount of a secondary fuel is a relatively low-energy/low-polluting fuel.

It is still yet a further object, feature, and/or advantage of the present invention to provide a system which further minimizes harmful emissions. In particular, biochar produced by gasifying biomass in a downdraft gasifier, or biochar used separately in an updraft gasifier, serves as a "scrubbing" agent for harmful emissions.

It is still yet a further object, feature, and/or advantage of the present invention to provide a system which can recycle high-carbon biochar and thereby reduce the amount of solid fuel by-products produced in the process.

The gasification system disclosed herein can be used in a wide variety of applications. For example, the gasifiers can burn tire rubber, plastics, paint filters, etc. and fossil fuels such as coal. Heat transferred from the dirty fuels gasifier/pyrolyzer syngas can increase the efficiency of the clean fuels gasifier that results in increased amounts of steam for electricity/power production. Exhaust emissions using this method generally do not require scrubbing when combusted. In lieu of producing steam, the syngas from the clean fuel gasifier can be used to fuel an engine for power production.

It is preferred the gasification system be safe, cost effective, and durable. For example, components of the gasifiers can be adapted to resist thermal decomposition and other types of failure (e.g., cracking, crumbling, shearing, creeping) due to prolonged operation of same.

Methods can be practiced which facilitate use, manufacture, assembly, maintenance, and repair of a gasification system which accomplishes some or all of the previously stated objectives.

These and/or other objects, features, advantages, aspects, and/or embodiments will become apparent to those skilled in the art after reviewing the following brief and detailed descriptions of the drawings. Furthermore, the present disclosure encompasses aspects and/or embodiments not expressly disclosed but which can be understood from a reading of the present disclosure, including at least: (a) combinations of disclosed aspects and/or embodiments and/or (b) reasonable modifications not shown or described.

BRIEF DESCRIPTION OF THE DRAWINGS

Several embodiments in which the present invention can be practiced are illustrated and described in detail, wherein like reference characters represent like components throughout the several views. The drawings are presented for exemplary purposes and may not be to scale unless otherwise indicated.

An artisan of ordinary skill in the art need not view, within isolated figure(s), the near infinite number of distinct permutations of features described in the following detailed description to facilitate an understanding of the present invention.

DETAILED DESCRIPTION OF THE INVENTION

The present disclosure is not to be limited to that described herein. Mechanical, electrical, chemical, procedural, and/or other changes can be made without departing from the spirit and scope of the present invention. No features shown or described are essential to permit basic operation of the present invention unless otherwise indicated.

Figure 1:
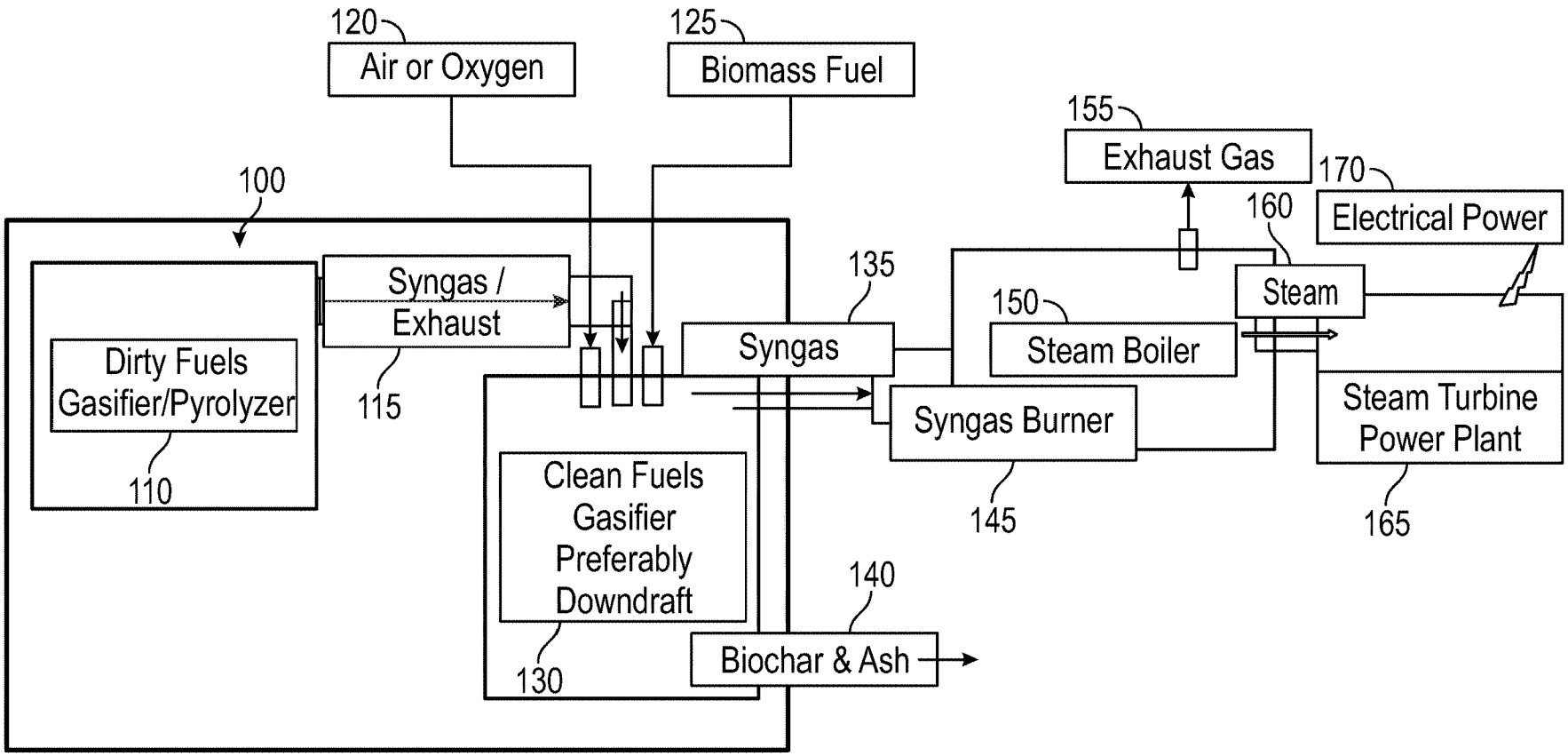
FIG. 1 shows a schematic view of an improved method and apparatus for a combined tire pyrolyzer/gasifier and biomass gasifier.

Referring now to the gasification system 100 of FIG. 1, a first gasifier/pyrolyzer 110 combines the use of dirty fuels with clean fuels. Heat is created for the purpose of producing steam for the co-generation of mechanical power and electricity. The dirty fuels are converted in the gasifier/pyrolyzer 110 into various useful products that include syngas 115, heat, and oils. For example, rubber tires, when exposed to liquid nitrogen, undergo a transformation and become brittle like a glass. The rubber tires can then be pulverized, which are further reused as additives in highway surfaces, parks, stadiums, and many other surfaces. Pulverized tire rubber can also be used as a solid-fuel additive. Rubber tires can thus be recovered and reused at the end of their life.

The syngas 115 that is produced by the dirty fuels normally emits pollutants when combusted that require scrubbing, however when the syngas 115 is combusted into a biomass gasifier 130 the dirty fuel emissions are scrubbed by being reformed into a much cleaner syngas/producer gas 135, greatly reducing or totally eliminating the need to scrub the emissions from the dirty fuels gasifier/pyrolyzer. In this process, heat transferred from the dirty fuels gasifier/pyrolyzer syngas 115 increases the efficiency of the clean fuels gasifier 120 that results in increased amounts of steam 160 for electricity/power production.

Temperatures produced during gasification in the downdraft gasifier 130 will be on the order of 1200 to 2400 degrees Fahrenheit. The reaction of biomass 125 and air 120 in the down draft system flows downward through the gasifier's char bed, causing solid, non-burnable materials, including the heavy materials from the gasification of the biomass and dirty exhaust, to precipitate or fall out as an ash that can be removed by an ash auger. The ash (mostly minerals) can then be properly treated and/or disposed of. In this process, pollutants are either chemically decomposed (scrubbed) or precipitated out of the core along with the other solid, non-burnable materials.

Figure 2:
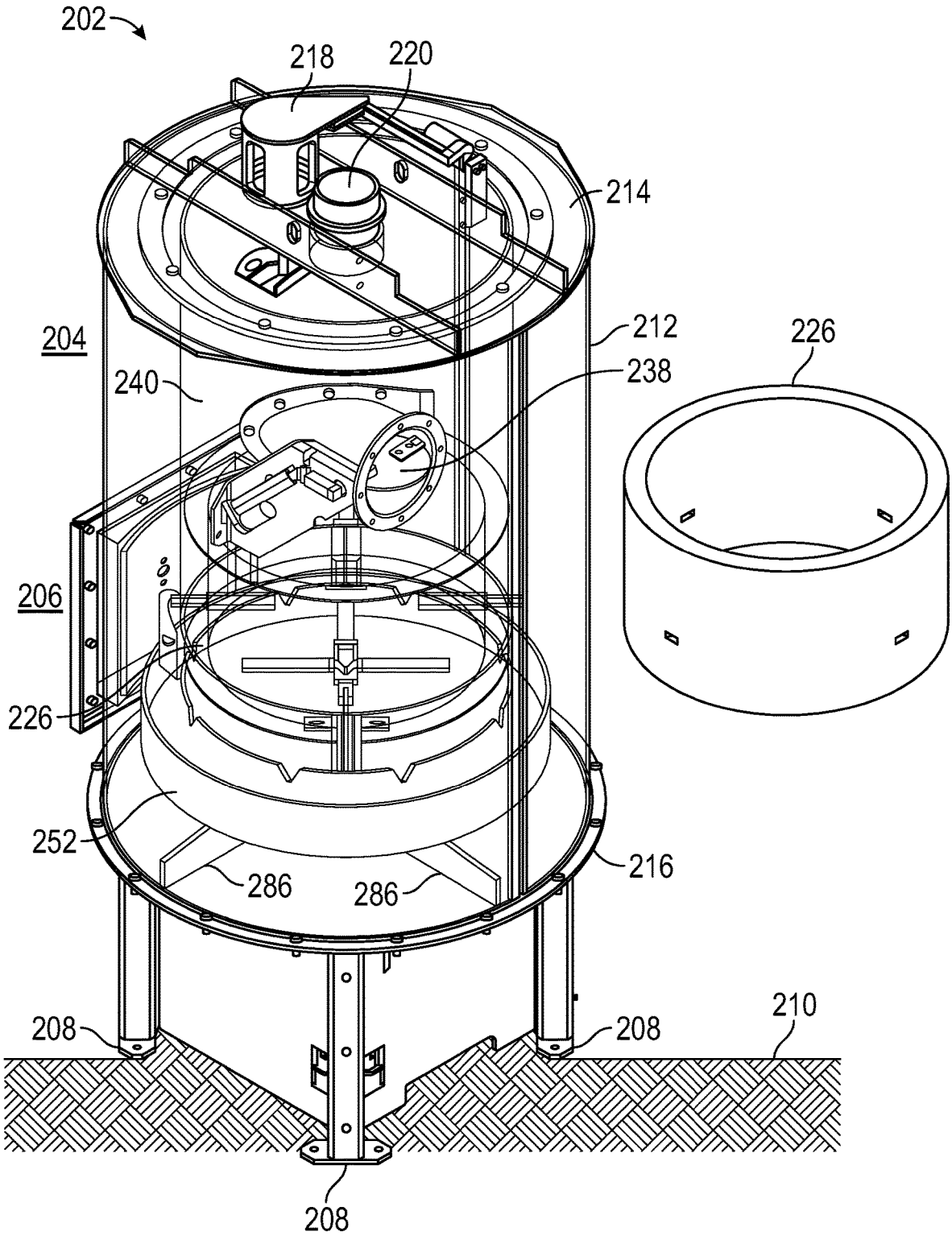
FIG. 2 shows a perspective view of a biomass gasifier system, emphasizing view of the quartile refractory height.
Figure 3:
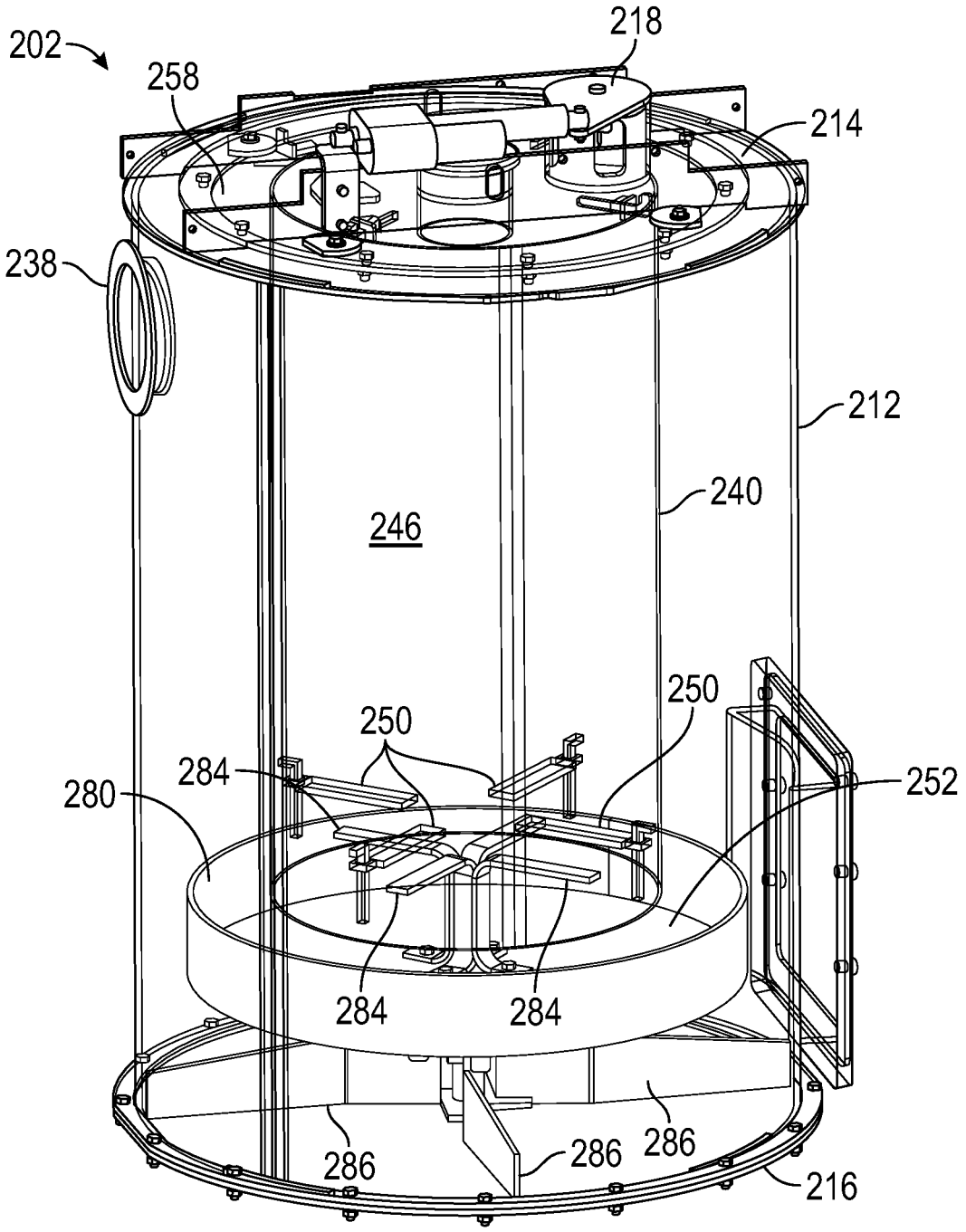
FIG. 3 shows a detailed, alternate perspective view of a biomass gasifier, emphasizing internal components of the gasifier of FIG. 2.

In lieu of downdraft biomass gasifier 130, an updraft biochar gasifier can also be employed and benefit from several aspects of the present disclosure. Moreover, additional gasifiers can be added in parallel, as shown in FIG. 2 of U.S. Pat. No. 6,637,206, to accommodate higher amounts of exhaust 115/135 or in series, as shown in FIG. 3 of U.S. Pat. No. 6,637,206, to further clean either exhaust(s) 115/135. A twin or dual sidedraft gasifier might also be used.

Other outputs from the clean fuels/downdraft gasifier 130 can therefore include biochar and ash.

Additional scrubbers can be used, if necessary to further control air pollution and to protect the environment by removing harmful chemicals and acids from polluted gas.

Conventionally, there are multiple types of scrubbers that aid in this process, including wet, dry, and electrostatic scrubbers.

Here, some embodiments will beneficially employ a dry industrial scrubber. The liquid-gas association of wet scrubbers increases the moisture level of the gas that is being expelled from the scrubber and can thus suffer from corrosion. Unlike wet industrial scrubbers, dry scrubbers do not need to use a liquid to absorb contaminants. Steam is not produced by the reaction of dry scrubbers, and thus a wastewater system is not necessary. Dry scrubbers can be used to remove acids found within gasses.

In some embodiments, these scrubbers remove pollutants that can be processed and be profitable as end products themselves. However, in many if not most cases, the scrubbing ability of the secondary biomass gasifier will be sufficient to ensure overall emissions coming from the system meet emissions standards. An example of a useful product includes gypsum extracted from scrubbers used in coal power plants. Pollutant products may require further processing in order to be become a useful end product. The gasification system 100 includes carbon adsorber(s) in the form of the biomass gasifier 130 carbon adsorption removes volatile organic compounds (VOCs) and many compounds that contain sulfur, such as mercaptans and hydrogen sulfide, from vapor streams. The type of carbon, nature of the contaminant, gas flow rates, temperature, among other factors affect the performance of adsorption systems. The rotating-bed gasifiers core reactor performs the carbon adsorption function that does not require pumps to recirculate the scrubbing solution, liquid distribution systems, or mist eliminators. The biomass gasifier's 130 char bed removes most, if not all, VOCs that pass through scrubbers because it combines high-temperature (thermal) scrubbing within the carbon absorber.

Activated carbon can be manufactured from biochar produced as a byproduct of the biomass gasifier 130. The activated carbon may be impregnated or mixed with certain chemicals, i.e., sodium hydroxide, calcium carbonate, or potassium hydroxide to enhance its performance during adsorption of various compounds.

Exhaust emissions using the method 100 generally do not require scrubbing when combusted. In lieu of producing steam, the syngas 135 from the clean fuel gasifier 130 can be used to fuel an engine for power production.

The biomass syngas 135 is a valuable fuel useful for heat production. The biomass syngas 135 supplied to the syngas burner 145 produces a great amount of heat when delivered into the of the combustion chamber of a boiler 150. The high amount of low-calorific biomass syngas 135 is generally enough to power the boiler without additional oil burner fuel and with almost no processing of flue gases. This is possible even for low-calorific biomass syngas 135 due to the fact that almost half of the total energy of the gas is in the form of heat. The rest of the energy, produced mostly from the hydrogen, carbon monoxide and methane of the biomass syngas 135, is sufficient to sustain combustion. The process of burning syngas 135 is practical even where combustible gases comprise only a fraction of the mass of the syngas 135.

The syngas burner 145 provides a compact solution for burning gases with low heat value without any additional auxiliary fuel and with high efficiency and availability. The syngas burner 145 can be operated reliably as the combustion chamber for either fire-tube boilers or water-tube boilers. The burners of the syngas burner 145 can be operational (hybrid burners) where (i) supplied with auxiliary fuel (gas/oil) for burner start-up and (ii) in situations where the primary fuel is not available.

Water in the steam boiler 150 absorbs heat from the syngas burner 145, creating steam 160. This steam 160 may be used to provide thermal, mechanical or electrical energy. Preferably, the steam 160 is routed to a steam turbine power plant 165. Optionally, a compressor may be added to provide the high-pressure steam typically needed for power generation. The steam turbine power plant 165 can include generators that creates electricity 170. During this process, the steam in the steam turbine power plant 165 condenses into water that can be recycled for use in the steam boiler 150.

It is to be appreciated other suitable evaporators that utilize working fluids other than water/steam can be used in lieu of the steam boiler 150. For example, in thermal engineering, the Organic Rankine Cycle (ORC) is a type of thermodynamic cycle. It is a variation of the Rankine cycle named for its use of an organic, high-molecular-mass fluid whose vaporization temperature is lower than that of water. The fluid allows heat recovery from lower-temperature sources such as biomass combustion, industrial waste heat, geothermal heat, solar ponds etc. The low-temperature heat is converted into useful work, that can itself be converted into electricity. The working principle of the ORC can be the same as that of the Rankine cycle of the steam boiler 150: the working fluid is pumped to an evaporator where the working fluid is evaporated, passed through an expansion device, such as a turbine, screw, scroll, or other expander, and then through a condenser heat exchanger that is finally condensed. The expansion is isentropic and the evaporation and condensation processes are isobaric. In the heat exchangers, the working fluid takes a long and sinuous path which ensures good heat exchange but causes pressure drops that lower the amount of power recoverable from the cycle. Likewise, the temperature difference between the heat source/sink and the working fluid generates exergy destruction and reduces the cycle performance. Additionally, the heat produced from burning the syngas can be used to operate a Stirling engine that is connected to a power generator.

Clean fuels gasifier 130 comprises a rotating bed gasifier assembly 200. FIGS. 2 and 3 show that the rotating bed gasifier assembly 200 begins with a gasifier container assembly 202. The gasifier container assembly 202 generally has a cylindrical shaped sidewall 212. However, the sidewall 212 can be in other shapes. Connected to the sidewall 212 is a top 214 and a bottom 216. Preferably, the bottom 216 allows used ashes and overflow fuel or char to fall to a central point, which can be connected to an ash sump, auger, or the like, for removing the fuel and ashes after they have been through the gasification process and fallen to the bottom of the rotating bed gasifier assembly 200. The waste ashes can be separated from the char or fuel by an ash separator, not pictured. The ash separator may have a screen for separating the waste ashes from the char or fuel which is to be recycled. Once separated, the ashes can be removed through the ash output, not pictured.

The char itself is made of many components. The components of the char are ultimately determined by what biomass is used. Generally, the char will have carbon and hydrogen. In embodiments of the invention, the char will have a carbon content of at least about 50 wt. %, preferably at least 55 wt. %, more preferably, at least 60 wt. %, most preferably at least 65 wt. %. In preferred embodiments the char will include at least carbon, hydrogen, and nitrogen.

Thus, it has been found that the process of the present invention creates char which has a high carbon content, preferably a carbon content of at least 50%. This means the char of the present invention's process can be extracted and used in conjunction with other processes, such as using it with iron ore to make steel. Additionally, the char can be processed, with or without additives such as fertilizers, insecticides, and herbicide, as agricultural field applications. The gas created by the gasification process in the rotating bed gasifier assembly 200 can also be extracted from the gasifier 202 through one or more ports 238. The gas can then be used as an energy source for other systems.

The gasifier 202 is separated into a top part 204 and an overlapping bottom part 206. Legs 208 support the bottom part 206 while a second support system (such as a scaffolding, legs, ceiling-mounted support, or other commonly known structure, not pictured) supports the top part 204. The legs 208 are mounted to the floor 210.

Figure 4:
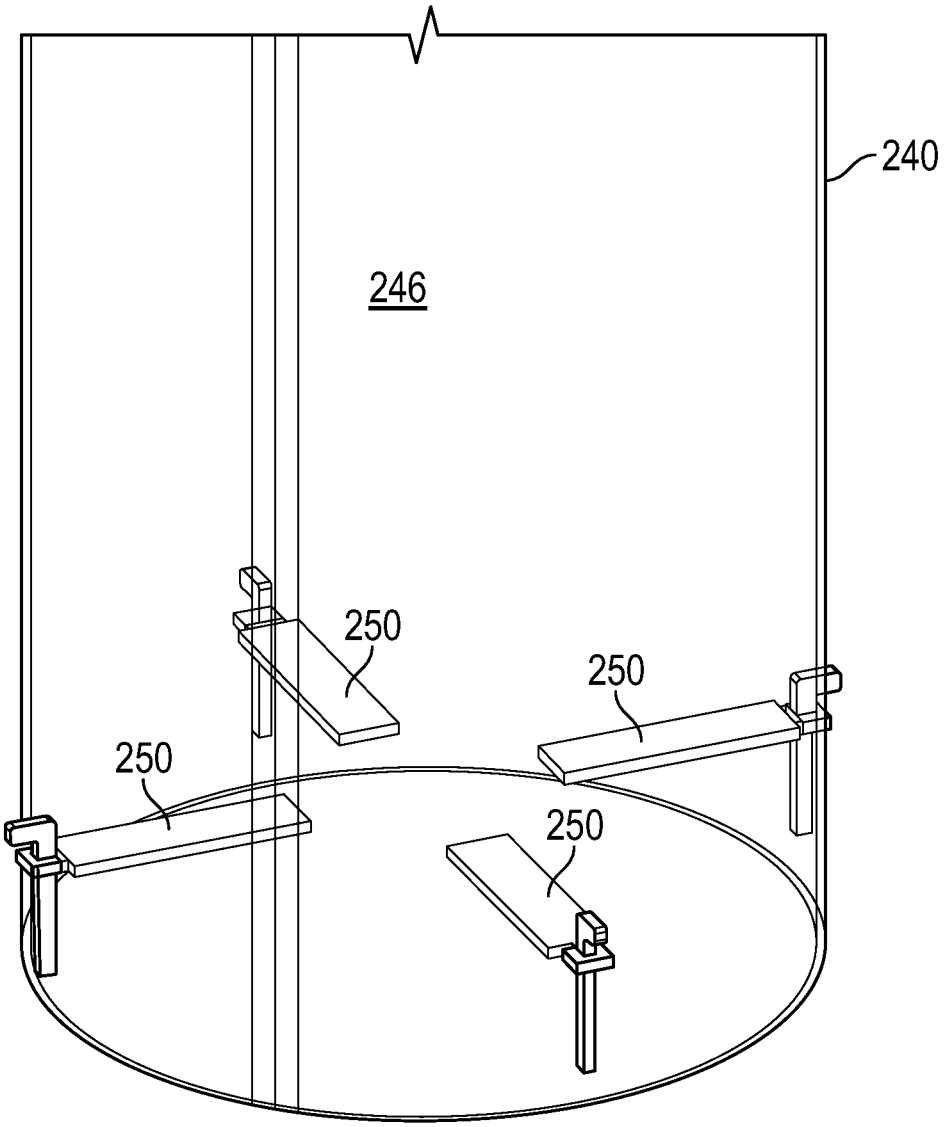
FIG. 4 shows a detailed view of the upper stir bars of the gasifier of FIG. 2.

Looking now at FIGS. 2 and 3, the rotating bed gasifier assembly 200 has a vertical shaft 240 which extends through the gasifier container assembly 202 creating a fire tube 246. Preferably, as shown in FIGS. 3 and 4 the shaft 240 has one or more fingers 250 extending from a lower portion of the shaft 240. The fingers 250 can extend at any angle from the shaft 240. The fingers 250 allow for breaking up the fuel as it falls down and enters the fire tube 246 and during the gasifying process.

Below the shaft 240 is a rotating trough/bed 252. This rotating or revolving bed 252 allows for the solid fuel which rests on the bed 252 and rotates with the bed 252 to revolve, thereby creating more distribution of uniform heat within the circumference of the fire tube 246. This is accomplished by slowly moving the hot spots within the solid fuel around inside the fire tube 246 thereby more uniformly heating the inside of the fire tube 246. In addition, the bed 252 can rotate intermittently and/or reverse directions.

It is understood that the rotating bed gasifier assemblies 200 can have different shaped or designed rotating beds 252. In addition, the rotating bed 252 can be created with titanium, stainless steel, sheet metal, perforated metal, expanded metal, or any other material suitable for holding the fuel which is to be gasified. Furthermore, the rotation of the bed 252 can be any appropriate speed or direction. It is important, however that the speed of the rotating bed 252 not be so fast as to reduce or impede the gasifying process.

The preferred fuel for this gasifier is shelled corn, wood pellet, and/or appropriately-sized wood chips or ground cobs. However other fuels can be used. In addition to biomass fuel, plastic fuel can be combined with biomass fuel to form a fuel blend. Because the plastic is a petrol-chemical derivative, it burns much faster than the biomass fuel. As a result, a filtering effect with this blended fuel can be accomplished by introducing dirty gasses from petrol/fossil fuels which are burned separately in a combustor similar to that as shown as a gasification system 100 in FIG. 1. Many dirty fuels cannot be blended in this way because of metal which is contained within them. Using dirty fuels with metallic contents would clog the gasifier. Examples of such dirty fuels are tire fluff, medical waste, and circuit boards. For example, a typical used tire when burned directly creates an array of toxic byproducts such as dioxins, furans, PAHs, PCBs, hexavalent chromium, and cadmium. Other toxic byproducts from tire burning include mercury, lead, nickel, beryllium, xylene, toluene, phenol, phosgene, mono-chlorobenzene, napthalene, formaldehyde, and acetaldehyde. Similar observations can be made for bituminous coal. However, if the plastics/rubber are homogeneous, blending them with biomass in the proper amount allows their clean burning while increasing the energy output from the gasifier. While any type of fuel can be used within the gasifiers of the present invention, it is noted that petro-chemical derived fuels cannot easily be gasified by themselves and cannot be downdraft gasified. These fuels melt which in turn restricts the necessary air flow and therefore severely limits or stops the gasification process.

Air is sucked, blown, or both through the fuel which is heated and pyrolyzed, forming gas for the gasification process. The gasification process is self-sustaining with a blower (not shown) operating. The rotating bed 252 replaces the function of a fixed grate in standard gasifiers in the art. The gasification process generally continues until the blower (not shown) or rotating bed 252 stops.

The direction of rotation of the rotating bed 252 can be clockwise or counterclockwise. In addition, the bed 252 can agitate, move intermittently, or a varying speeds, whatever motion works best for the fuel which is being used. It is preferred that the ring-type rotating troughs 252 are used in place of the pan-type rotating trough 252 once the specifications require the rotating tray to be larger than approximately 36 inches in diameter. This ensures better fuel agitation, which is necessary to overcome the problems of biomass gasification.

Additionally, it is preferred as shown in FIG. 2, but not necessary, that the bed 252 have sidewalls 280 to reduce the amount of fuel falling off the bed 252 before it is thoroughly gasified. In other words, the fuel should remain on the bed 252 until the gasified fuel becomes light enough and high enough to fall over the sidewalls 280 and down to the central point. Furthermore, the bed 252 preferably has one or more fingers 284 extending upward from the bed 252 which allow the rotating bed 252 and the fuel to revolve and mix in a crossing path with the fingers 250 extending from the shaft 240. In other words, the fingers 250, 284 pass one another during revolution of the bed 252 and mix the fuel. This aids in more thorough gasification of the fuel. In addition to reinforcing the rigidity and supporting the rotating tray 252, the braces or brackets 286 serve to move char/ash to the removal sump where it can be augured out by an auger.

Preferably, the lower part of the shaft 240 has an additional inside sleeve 226 near the rotating trough/bed 252. The additional inside sleeve 226 insulates the heat of the gasifying process in the fire tube 246. The additional inside sleeve 226 can be created with ceramics, refractory ceramics, or any other material suitable for insulating the heat during the gasifying process.

Figure 5:
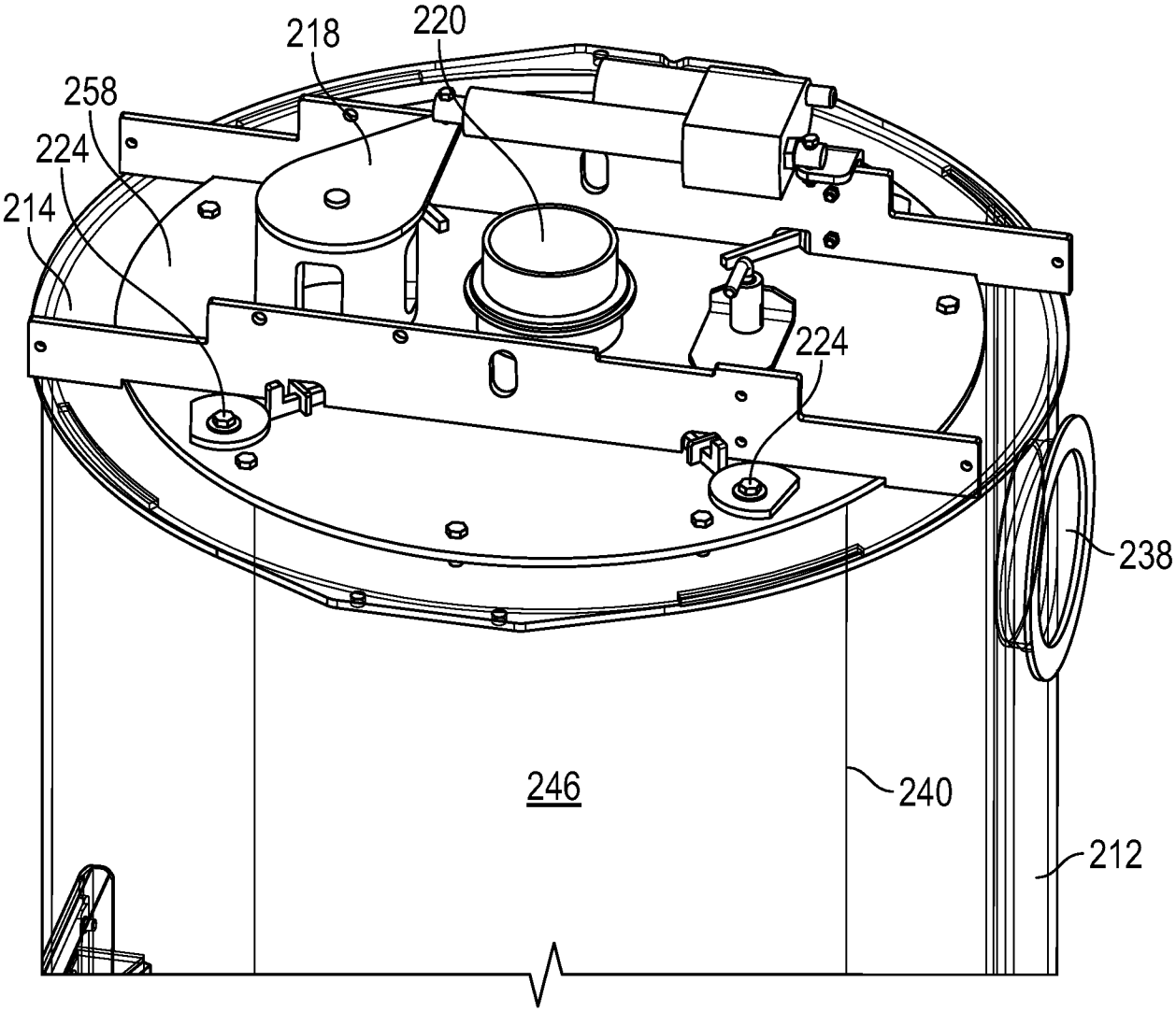
FIG. 5 shows a detailed view of a fire tube attachment assembly of the gasifier of FIG. 2.
Figure 6A:
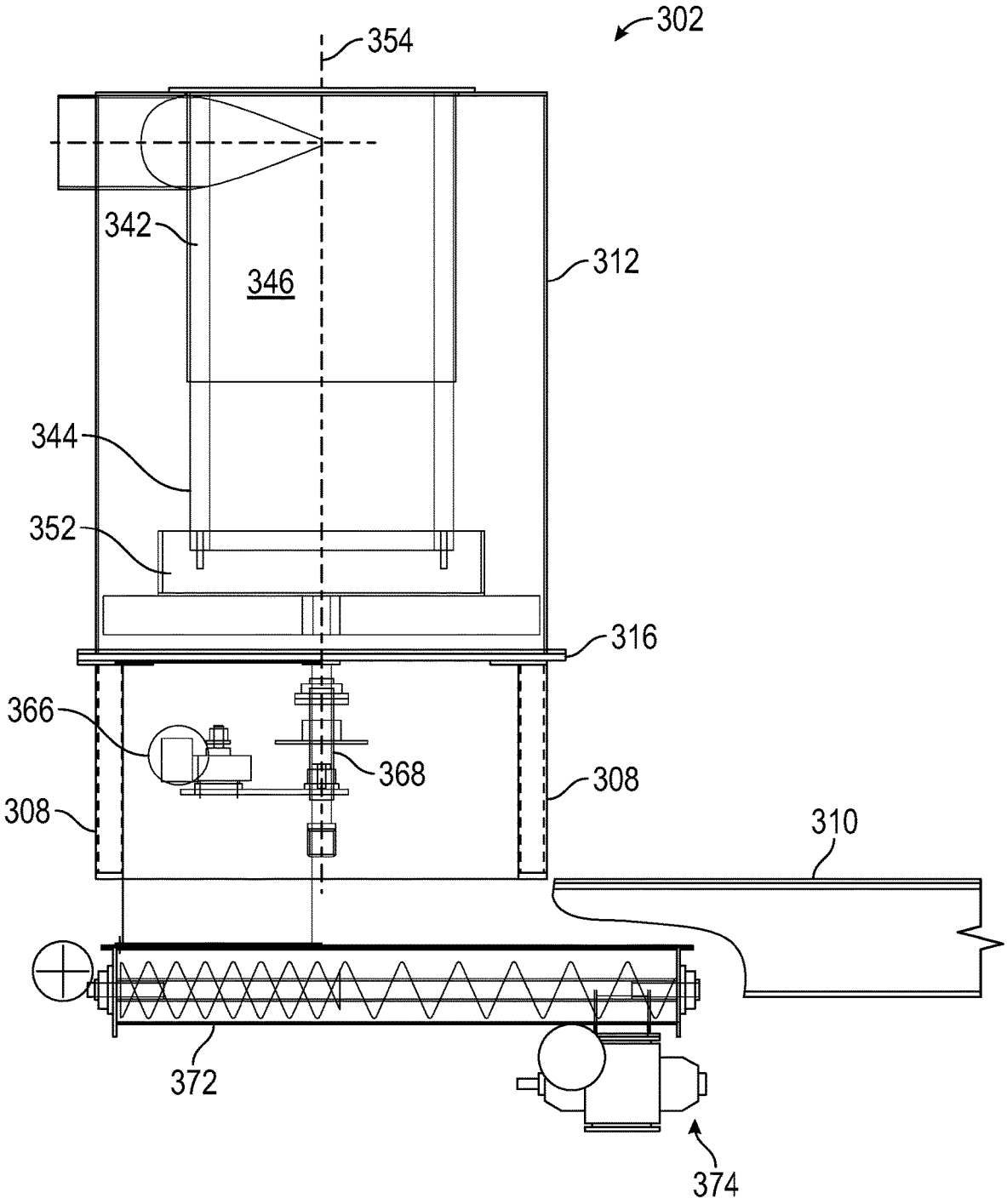
FIG. 6A shows a two-dimensional engineering front elevation view of an exemplary biomass gasifier.
Figure 6C:
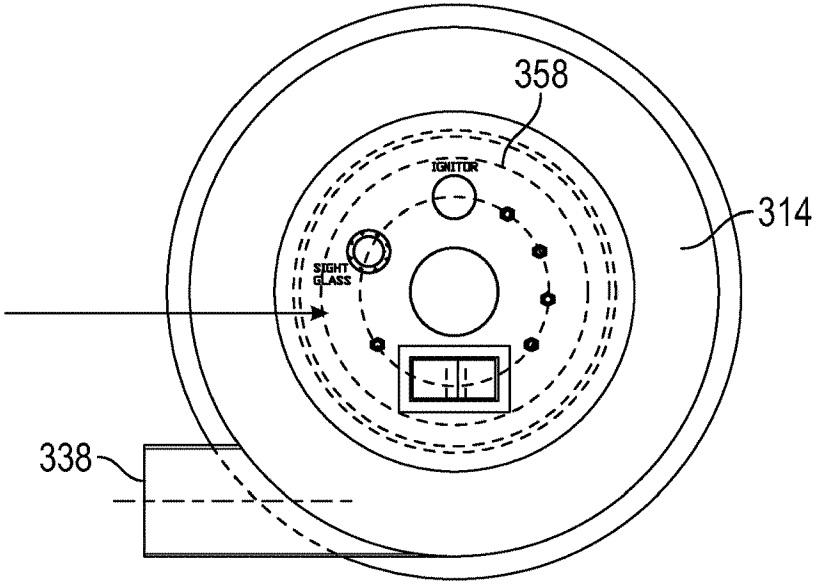
FIG. 6C shows a two-dimensional engineering top plan view of an exemplary biomass gasifier.
Figure 6B:
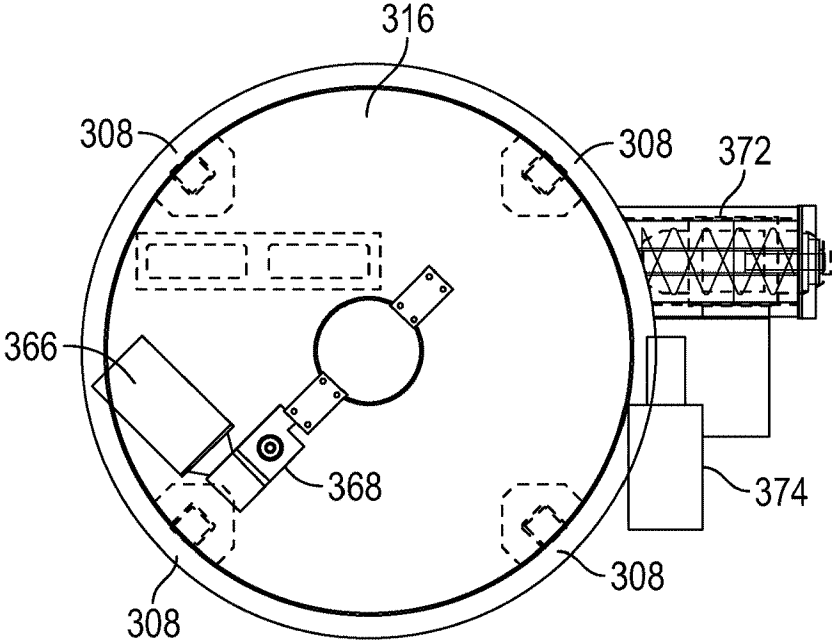
FIG. 6B shows a two-dimensional engineering bottom plan view of an exemplary biomass gasifier.
Figure 6E:
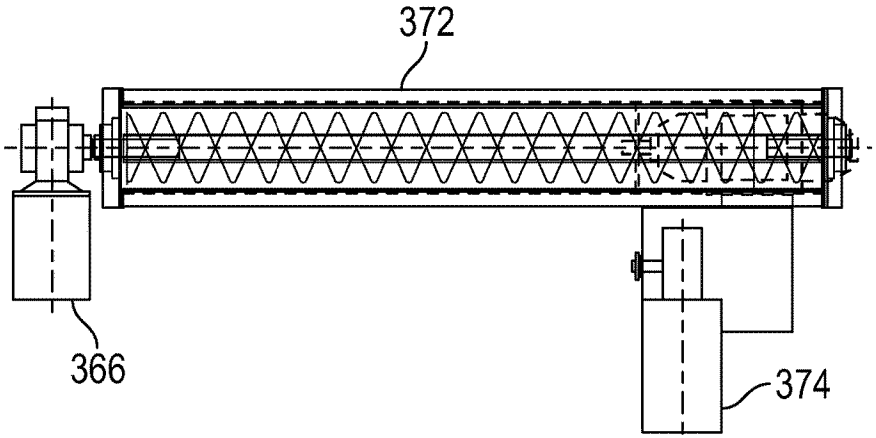
FIG. 6E shows a two-dimensional engineering cross-sectional, component view of an exemplary biomass gasifier.
Figure 6D:
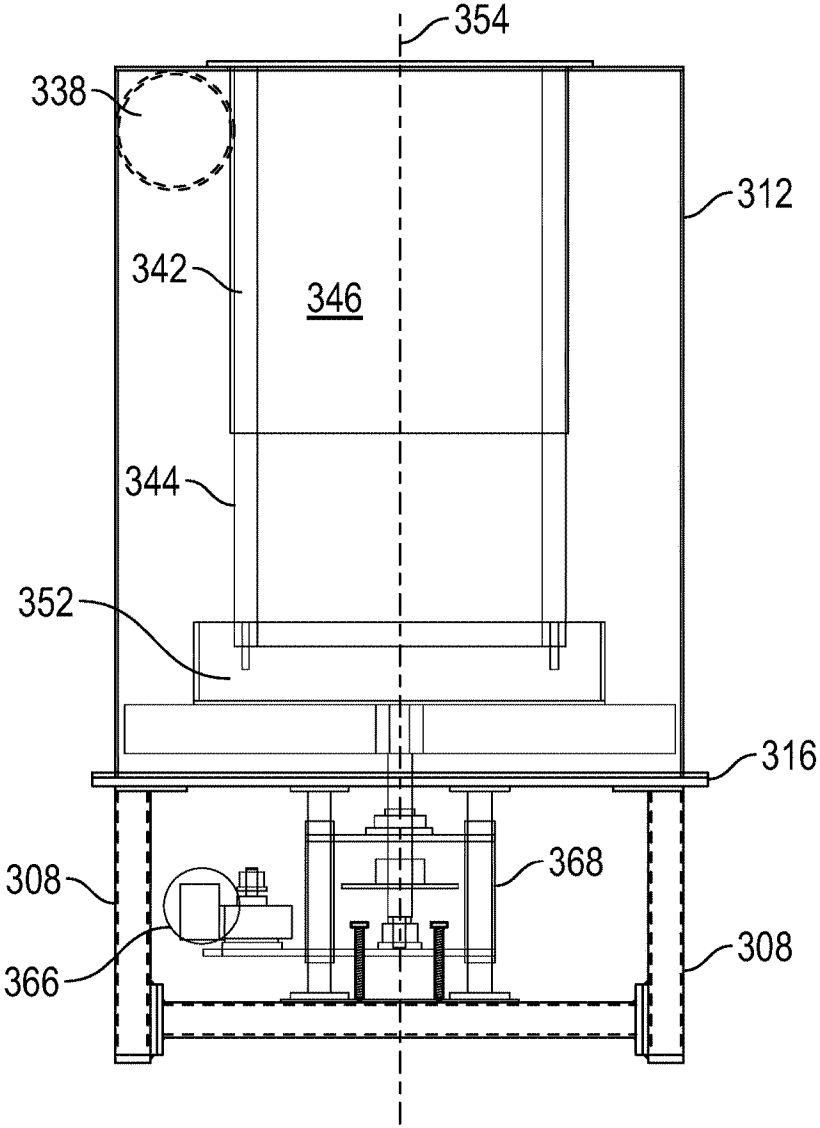
FIG. 6D shows a two-dimensional engineering side elevation view of an exemplary biomass gasifier.

FIG. 5 is a view of a particular gasifier configuration showing the top 214. On the top 214 are located three holes, a fuel opening 218 and an air opening 220. The air opening 220 is closable by an adjustable cover which regulates the fuel flow through the fire tube 246. The fuel opening 218 allows a fuel tube to pass through, delivering new or recycled fuel to the bed 252.

As shown in FIG. 5, screws 224 pass through the top 214 and engage the cap 258. The cap 258 has corresponding locations (which may be weld nuts, tapped holes, threaded posts, or similar structure known in the art) which receive the screws 224 (threaded rods, internally threaded bars, or other structure complementing the locations). The screws 224 are not threaded completely into the locations, but rather a space is left between the cap 258 and the top 214. By adjusting the screws 224, the cap 258 can be raised or lowered as desired. The cap 258 is permanently affixed to the top of the shaft 254, therefore as the cap 258 is raised or lowered by adjusting the screws 224, the shaft 254 is raised or lowered relative to the rotating bed 252.

As further shown in FIG. 5, the cap 258 is appropriately sized to accommodate the fire tube 246 as it is raised or lowered. Additionally, the shaft sleeve 256 is sized appropriately so as to remain in continuous contact with the drive shaft 254 which remains fixed as the cap 258 is raised and lowered.

In the embodiment shown in FIGS. 6A-E, the gasifier container assembly 302 generally has a cylindrical shaped sidewall 312. However, the sidewall 312 can be in other shapes. Connected to the sidewall 312 is a top 314 and a bottom 316. Legs 308 support the bottom 316 and the legs 308 are mounted to the floor 310. The gasifier 302 has a first vertical shaft 342 and a second vertical shaft 344 located concentrically inside the first vertical shaft 342 extending downward or vertically into the gasifier 302 creating a fire tube 346. This creates an elongated ring fire tube 346 as shown in in FIG. 6. However, the second shaft 344 does not rotate with the rotating trough/bed 352. The gas created by the gasification process in the gasifier assembly 300 can also be extracted from the gasifier 302 through one or more ports 338.

In the embodiment shown in FIG. 6, the gasifier assembly 300 has a rotating trough or bed 352 connected to a drive shaft 354 for revolving the rotating bed 352. There is preferably a bearing (not shown) at the top and the bottom of the drive shaft 354 to facilitate even rotation and long life. Preferably, the drive shaft 354 has a sprocket 368 which connects to a motor assembly 366 for rotating the bed 352. Again, it is preferred that the bed 352 rotates approximately one revolution every four minutes, however other rotations can be used with the present invention.

The rotating bed 352 is attached to a drive shaft 354 which is connected in this configuration to a sprocket and/or pulley 368. The sprocket and/or pulley 368 is shown vertically oriented, and in turn connects to the motor 366 via another sprocket and/or pulley 368 and a chain or belt. There is preferably a bearing (not shown) at the top and the bottom of the drive shaft 354 to facilitate even rotation of the drive shaft 354 and long life. A configuration with direct-drive variable speed motor is also possible There may also be fingers extending from the drive shaft 354 to aid in mixing the fuel. The motor 366 is preferably geared down so the drive shaft 354 and the rotating bed 352 rotate inside the gasifier assembly at approximately one revolution every four minutes.

According to one embodiment of the invention, the bed 352 of the gasifier 300 is adjustable in height relative to either the fire tube 346 or the enclosure 302, thereby regulating fuel flow to the burning fuel.

According to an embodiment, the bed 352 has a tube attached to the bottom and surrounding the second shaft 344. The tube is keyed to the shaft 344 along its length so the bed 352 may be adjusted up or downwards as required without needing to adjust the shaft 344 and motor 366. The tube may have a thread thereon, corresponding to a worm gear on a second motor 374. The second motor 374 can be connected to an auger 372 which serves to move char/ash to the removal sump where it can be augured out by an auger.

Figure 7A:
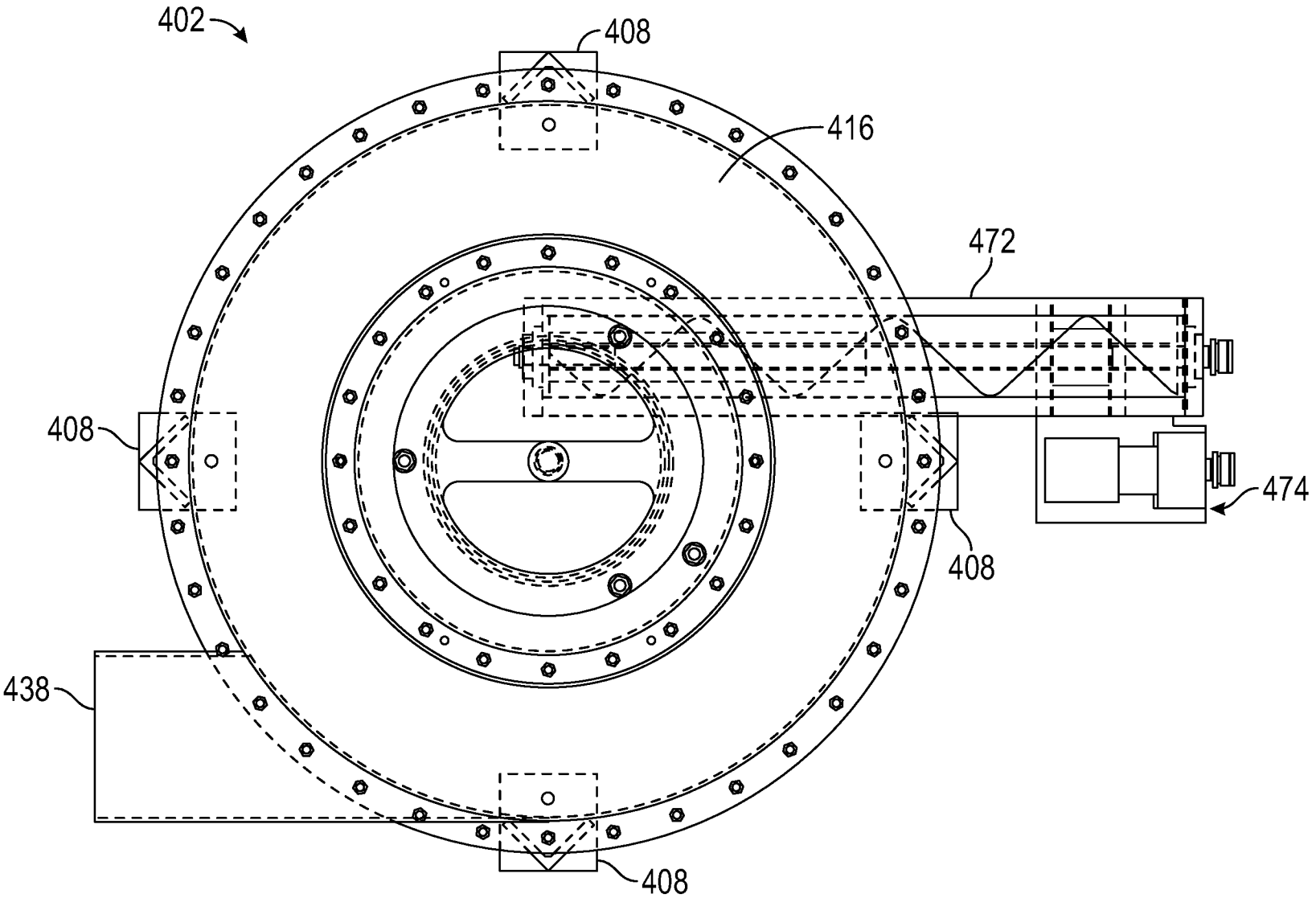
FIG. 7A shows a two-dimensional engineering top plan view of another exemplary biomass gasifier.
Figure 7B:
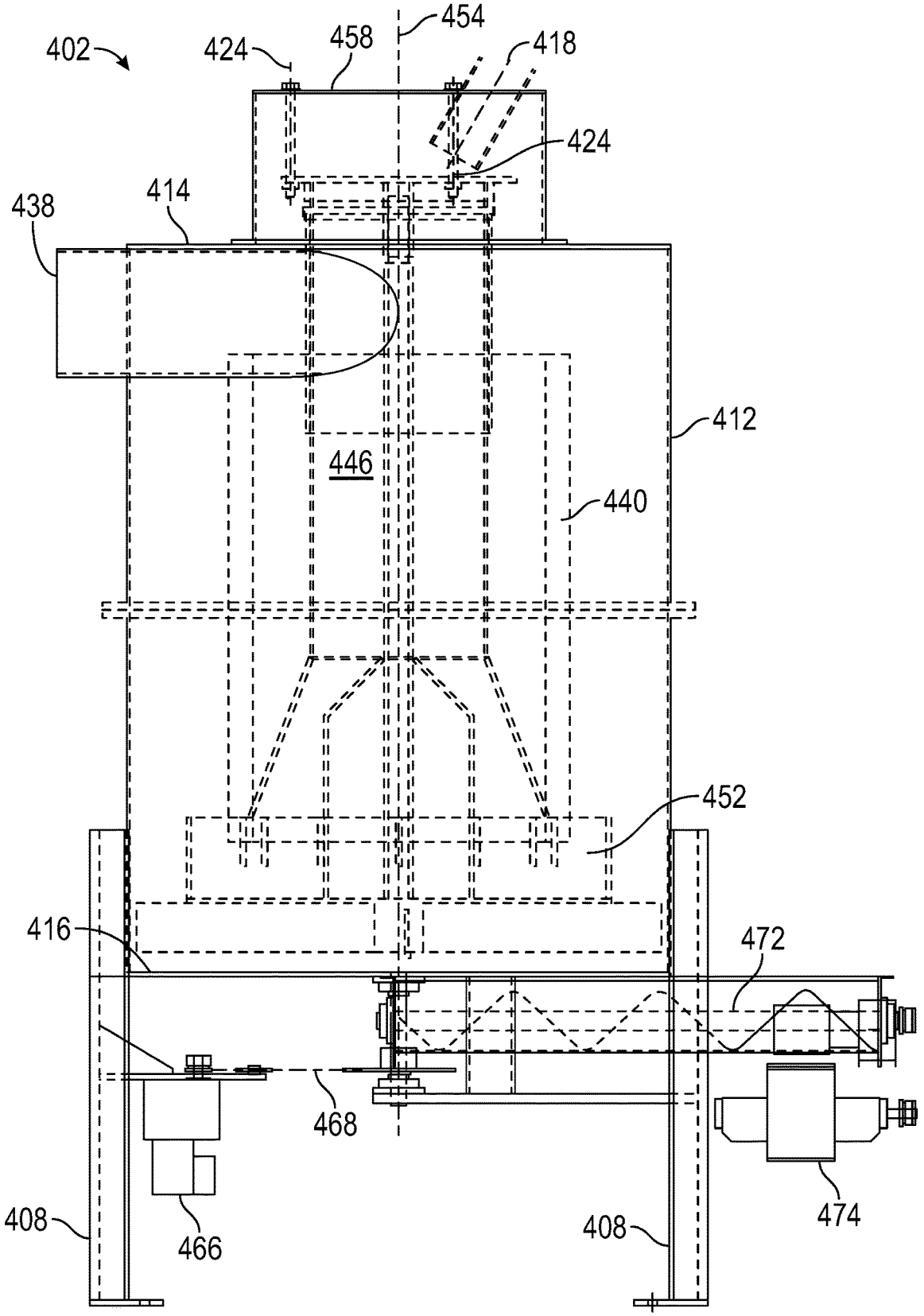
FIG. 7B shows a two-dimensional engineering front elevation view of another exemplary biomass gasifier.

One specific embodiment is shown in FIGS. 7A-B. In this example, the gasifier 400 has an gasifier container assembly 402 with side walls 412, top 414, bottom 416, legs 408, a fuel opening 418, and one or more ports 438. Screws 424 pass through the top 414 and engage the cap 458. Within the enclosure 402 the vertical shaft 440 creates a fire tube 446 extending downwardly from the top 414 to a bed 452. The bed 452 has raised sidewalls which serve to contain fuel, char and ash during the gasification process.

According to an embodiment, the bed 452 has a tube attached to the bottom and surrounding the vertical shaft 440. The tube is keyed to the vertical shaft 440 along its length so the bed 452 may be adjusted up or downwards as required without needing to adjust the vertical shaft 440 and motor 466. Preferably, the drive shaft 454 has chain or belt 468, horizontally oriented, attached to a sprocket which connects to a motor assembly 466 for rotating the bed 452. The tube may have a thread thereon, corresponding to a worm gear on a second motor 474. The second motor 474 can be connected to an auger 472 which serves to move char/ash to the removal sump where it can be augured out by an auger.

According to an alternative embodiment, drive shaft 454 is a telescoping shaft, having one or more shafts located within the drive shaft 454. The shaft forms the piston of a hydraulic or pneumatic piston. As hydraulic or pneumatic pressure is applied, the telescoping shaft extends, thereby raising the floor. The telescoping shaft may then be locked in this position by constant pressure or a mechanical interface, such as a pin, brace, screw, or other commonly known mechanical interface.

According to an alternative embodiment, bed 452 is attached to drive shaft 454 by a bearing and key, the key transferring rotation from the drive shaft 454 to the bed 452, and the bearing allowing movement of the bed 452 up and down the vertical shaft 440. A separate lift is attached to the bed 452, the lift providing vertical adjustment of the floor of the bed 452 according to demand. This lift may be a single or series of hydraulic pistons, a worm gear and threaded rod, or other form of lift.

According to an alternative embodiment, the sidewalls of the bed are formed by a continuous tube extending from the floor 410 (or bottom of the enclosure) and overlapping the fire tube. The bed 452 is movable, according to any of the above discussed alternatives, so the height of the sidewalls and gap between the bed 452 and fire tube 446 is adjusted.

In operation, a fuel is selected from a group for which the optimal fuel flow is known. The optimal fuel flow for a given fuel may be determined in a pre-production gasification process as the optimal rate of fuel flow may depend on the density of the fuel and consistency. The fuel is provided to the bed where it is heated and the bed is rotated to provide even heating throughout the fuel pile/gasifier reactor core. As the fuel is combusted, ash is produced, which builds up with the fuel or char on the bed against the sidewalls. Once the char and ash reach the height of the sidewalls, the material falls to the ash collector and the unburnt char is recycled into the fuel source. As the ash builds up, the air passageway between the bed and the shaft is occupied by the char and ash mixture.

At this point it becomes necessary for an operator, or automated control system, to monitor the temperature of the burning fuel or char and adjust the height of the floor to increase or decrease fuel flow to the fuel or char. It is expected that as ash and char builds up about the sidewalls of the floor, the bed may be lowered to increase fuel flow to the burning fuel or char. As efficiency of the system is increased due to increased fuel flow, the ratio of ash to unburnt fuel is increased, which may necessitate raising the bed to maintain fuel flow at a steady rate. It therefore may be necessary for an operator/control system to continuously monitor the temperature of the burning fuel or char, amount of ash production, and rate of fuel consumption in order to maximize energy captured during the gasification process.

It is also important to monitor the gas quality and quantity released by the burning fuel or char. Gases such as CO (Carbon Monoxide), CO2 (Carbon Dioxide), H (Hydrogen), and oxygen are important gasses which are used to determine both the quality of the useable gas but also the consumption rate of the fuel. In the useable gas produced, high levels of CO and H are desirable, while high levels of oxygen and CO2 are undesirable as indicators of combustion. It is contemplated by the present disclosure that an automated monitoring system may determine the concentration of these gases in the useable gas and automatically adjust the height of the bed or fire tube as necessary.

As an alternative embodiment, pure oxygen rather than ambient air may be injected into the system in order to produce a higher energy gas output. Other combinations of gasses may also be used without limitation, for example, half ambient air and half pure oxygen. Further combinations are anticipated as being within the scope of this disclosure.

The term "fuel flow" as used incorporates several concepts. As fuel is consumed and char and ash are produced, the lighter char and ash are pushed up the sidewalls of the bed. When this combination reaches the height of the sidewalls, the ash and char are forced over the edge to be collected and/or recycled. Fuel consumption rate must therefore conform to the waste disposal rate. If more fuel is added, the consumption rate increases and therefore the disposal rate must also increase. To do so, the bed may be adjusted so that more ash is disposed of from the bed. Additionally, the rate of consumption of the fuel is further limited due to the insulative properties of the char.

While the current method of raising and lowering the fire tube 446 is described as essentially a manual process, it may be preferable to automate the process, thereby reducing risk to operators and allowing for fully automated control of the gasification process.

As previously described in detail, it is necessary to maintain a consistent fuel flow through the burning fuel in order to achieve optimum combustion. By adjusting the height of the fire tube 446 relative to the rotating bed 452, additional fuel flows to and through the burning fuel. By carefully monitoring the consumption rate of the fuel as well as the amount of unspent fuel discharged, the optimum gap size can be determined.

Further, any of the above-described methods for adjusting the height of the rotating bed 452 relative to the fixed fire tube 446 may also be adapted to adjust the height of the fire tube 446 relative to a fixed bed 452. It may also be preferable in some environments to combine a movable bed 452 with a movable fire tube 446. Such an arrangement is contemplated by the present invention.

While the present invention also applies to a rotating bed gasifier, it is not the intention of this disclosure to limit the adjustable bed and fire tube to a gasifier having a rotating bed unless the rotating bed is expressly claimed. A fixed, nonrotating bed would be just as well served by the contemplated improvement.

From the foregoing, it can be seen that the present invention accomplishes at least all of the stated objectives.

It is understood that even though specific references are made to certain parts or sections of the invention in the figures, these specific parts or figures or design styles can be interchanged on any of the gasifiers as may be desired for a specific situation. In other words, any of the features or designs shown or contemplated can be used on any of the contemplated gasifiers.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims.

LIST OF REFERENCE CHARACTERS

The following table of reference characters and descriptors are not exhaustive, nor limiting, and include reasonable equivalents. If possible, elements identified by a reference character below and/or those elements which are near ubiquitous within the art can replace or supplement any element identified by another reference character.

TABLE 1

| List of Reference Characters | |
|---|---|
| 100 | gasification system/process |
| 110 | dirty fuels gasifier/pyrolizer |
| 115 | Syngas |
| 120 | air or oxygen |
| 125 | biomass fuel |
| 130 | clean fuels gasifier |
| 135 | Syngas |
| 140 | biochar & ash |
| 145 | syngas burner |
| 150 | steam boiler |
| 155 | exhaust gas |
| 160 | Steam |
| 165 | steam turbine power plant |
| 170 | electrical power |
| 200 | rotating bed gasifier assembly |
| 202 | gasifier container assembly |
| 204 | top part of enclosure |
| 20 | bottom part of enclosure |
| 208 | Legs |
| 210 | Floor |
| 212 | Sidewall |
| 214 | Top |
| 216 | bottom |
| 218 | fuel opening |
| 220 | air opening |
| 224 | Screws |
| 226 | additional inside sleeve |
| 238 | one or more ports |
| 240 | vertical shaft |
| 246 | fire tube |
| 250 | one or more fingers |
| 252 | rotating trough/bed |
| 254 | drive shaft |
| 256 | shaft sleeve |
| 258 | Cap |
| 280 | Sidewalls |
| 284 | another one or more fingers |
| 286 | support brackets |
| 300 | rotating bed gasifier assembly |
| 302 | gasifier container assembly |
| 308 | Legs |
| 310 | Floor |
| 312 | Sidewall |
| 314 | Top |
| 316 | Bottom |
| 338 | one or more ports |
| 342 | first vertical shaft |
| 344 | second vertical shaft |
| 346 | fire tube |
| 352 | rotating trough/bed |
| 354 | drive shaft |
| 366 | Motor |
| 368 | sprocket or pulley |
| 372 | Auger |
| 374 | second motor |
| 400 | rotating bed gasifier assembly |
| 402 | gasifier container assembly |

TABLE 1-continued

| List of Reference Characters | |
|---|---|
| 408 | Legs |
| 410 | Floor |
| 412 | Sidewall |
| 414 | Top |
| 416 | Bottom |
| 418 | fuel opening |
| 424 | Screws |
| 438 | one or more ports |
| 440 | vertical shaft |
| 446 | fire tube |
| 452 | rotating trough/bed |
| 454 | drive shaft |
| 458 | Cap |
| 466 | motor |
| 468 | chain or belt for sprocket/pulley |
| 472 | Auger |
| 474 | second motor |

GLOSSARY

Unless defined otherwise, all technical and scientific terms used above have the same meaning as commonly understood by one of ordinary skill in the art to which embodiments of the present invention pertain.

The terms "a," "an," and "the" include both singular and plural referents.

The term "or" is synonymous with "and/or" and means any one member or combination of members of a particular list.

The terms "invention" or "present invention" are not intended to refer to any single embodiment of the particular invention but encompass all possible embodiments as described in the specification and the claims.

The term "about" as used herein refer to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variable, given proper context.

The term "generally" encompasses both "about" and "substantially."

The term "configured" describes structure capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

A "fossil fuel" is a hydrocarbon-containing material formed underground from the remains of dead plants and animals that humans extract and burn to release energy for use.

"Biomass" as used herein is any organism that has not turned into a fossil fuel.

"Dirty fuels" as used herein include at least: waste materials such as tire rubber, plastics, and paint filters; and fossil fuels such as coal, oil, and natural gas.

"Biomass" is generally plant-based material used as fuel to produce heat or electricity. Examples are wood and wood residues, energy crops, agricultural residues, and waste from industry, farms and households. Animal wastes and carcasses are also biomass and can be used as fuel.

The "scope" of the present invention is defined by the appended claims, along with the full scope of equivalents to which such claims are entitled. The scope of the invention is further qualified as including any possible modification to any of the aspects and/or embodiments disclosed herein which would result in other embodiments, combinations, sub-combinations, or the like that would be obvious to those skilled in the art.

What is claimed is:

1. An apparatus for converting dirty fuels to steam and useful gas, the apparatus comprising:

an updraft gasifier or pyrolyzer for gasifying and/or pyrolyzing dirty fuels to produce heat and a dirty exhaust when burned;

a biomass gasifier configured to scrub, via gasification, the dirty exhaust containing high amounts of volatile organic compounds (VOCs), wherein:

the scrubbing involves reforming the dirty exhaust into a clean auxiliary syngas fuel, the biomass gasifier allows for the scrubbing of the dirty exhaust without using an additional scrubber and with substantially no processing of flue gas, and the biomass gasifier creates a char having a carbon content of at least 50 wt. %, and wherein the production of said char serves as the only scrubbing agent;

wherein the biomass gasifier operates at temperatures between 1200 and 2400 degrees Fahrenheit such that pollutants are chemically decomposed or precipitated out as ash;

a syngas burner that burns the clean auxiliary syngas fuel;

an evaporator receiving heat from the syngas burner to produce a working fluid;

a working fluid electric generator operatively linked to a boiler to produce electrical power from the working fluid; and a carbon adsorber or an activated carbon bed to remove volatile organic compounds (VOCs) and/or compounds that contain sulfur, such as mercaptans and hydrogen sulfide, from the exhaust, auxiliary fuel, and/or the working fluid, wherein activated carbon in the carbon adsorber or activated carbon bed is impregnated with sodium hydroxide or potassium hydroxide to enhance adsorption performance, and wherein the activated carbon is manufactured from biochar produced as a byproduct of the biomass gasifier.

2. The apparatus for converting dirty fuels of claim 1, wherein the working fluid is selected from the group consisting of: (i) water and (ii) an organic, high-molecular-mass fluid whose vaporization temperature is lower than that of water; and the evaporator is selected from the group consisting of: (i) a steam boiler and (ii) an evaporator included in an Organic Rankine Cycle (ORC), respectively.

3. The apparatus for converting dirty fuels of claim 1 wherein the clean auxiliary syngas fuel is a biomass syngas or an oil.

4. The apparatus for converting dirty fuels of claim 1 wherein the working fluid electric generator is a turbine.

5. The apparatus for converting dirty fuels of claim 1 wherein the dirty fuels are selected from the group consisting of used tires, used shingles, used plastics, and combustible medical waste.

6. The apparatus for converting dirty fuels of claim 1 further comprising a source of biomass material mixed in with the dirty exhaust, further wherein the biomass gasifier includes a rotating bed.

7. The apparatus for converting dirty fuels of claim 6 wherein the biomass material is selected from the group consisting of corn, wood, wood residue, energy crops, and agricultural residues, wherein the rotating bed further includes one or more fingers extending into the biomass material from the rotating bed.

8. The apparatus for converting dirty fuels of claim 7 wherein the biomass material is waste from industry, farms, households, and hospitals, and further wherein the biomass gasifier includes a shaft with one or more fingers extending radially inward, the shaft with one or more fingers extending radially inward being disposed above the rotating bed.

9. The apparatus of claim 1, wherein the char has a carbon content of at least 65 wt. %.

10. A method for providing electricity from the burning of dirty fuels while reducing harmful emissions, the method comprising:

providing a dirty fuel;

burning the dirty fuel in an updraft gasifier or pyrolyzer to create heat and syngas/exhaust;

transferring the exhaust from the burning of the dirty fuel to a downdraft or updraft biomass gasifier;

scrubbing, via gasification, said exhaust in the downdraft or updraft biomass gasifier so as to reform the exhaust to create a scrubbed clean biomass syngas, wherein:

the downdraft or updraft biomass gasifier allows for the scrubbing of the exhaust without using an additional scrubber and with substantially no processing of flue gas, the downdraft or updraft biomass gasifier further allows for creating a char having a carbon content of at least 50 wt. %, and the production of char serves as the only scrubbing agent;

burning the scrubbed clean biomass syngas in a syngas burner;

separating the char from waste ashes;

recycling the separated char back into the downdraft or updraft biomass gasifier;

using heat from said burning to create steam in a steam boiler;

routing the steam into a steam turbine;

turning the steam turbine to power a generator to create electricity;

returning condensed water from the steam turbine to the steam boiler; and filtering exhaust gas from the syngas burner through an activated carbon bed impregnated with sodium hydroxide or potassium hydroxide to remove VOCs and sulfur-containing compounds.

11. The method of claim 10 further comprising adding biomass material to the downdraft or updraft biomass gasifier.

12. The method of claim 11 further comprising operating the downdraft or updraft biomass gasifier with the syngas/exhaust and the biomass material to create gas, char, and ash.

13. The method of claim 12 further comprising removing the ash from the downdraft or updraft biomass gasifier with an ash auger.

14. The method of claim 13 further comprising allowing air to flow into the downdraft or updraft gasifier through a vent.

15. The method of claim 14 returning water from the steam turbine to the steam boiler.

16. An apparatus for co-generation of power that reduces the pollution of a burned primary fuel, the apparatus comprising:

an updraft gasifier for gasifying a primary fuel creating heat and dirty exhaust;

a downdraft biomass gasifier configured to scrub, via gasification, the dirty exhaust to reform the dirty exhaust into a clean auxiliary fuel, wherein:

the downdraft biomass gasifier allows for the scrubbing of the dirty exhaust without using an additional scrubber and with substantially no processing of flue gas, the downdraft gasifier comprises a rotating bed assembly that allows used ashes and a char to fall to a central point, which is connected to an auger for removing the fuel and ashes after they have been through the gasification process and fallen to a bottom of the rotating bed assembly, said char having a carbon content of at least 50 wt. %, and the production of char serves as the only scrubbing agent;

wherein the downdraft biomass gasifier comprises a rotating-bed gasifier that performs carbon adsorption without requiring pumps to recirculate scrubbing solution, liquid distribution systems, or mist eliminators;

a syngas burner for burning the clean auxiliary fuel;

a boiler operatively connected to the syngas burner for generating a hot gas;

an engine operatively linked to the downdraft biomass gasifier for turning the syngas into power;

a first generator operatively connected to an engine for turning the power into electricity; and a carbon adsorber or activated carbon bed configured to remove volatile organic compounds and sulfur-containing compounds from exhaust gas of the syngas burner, wherein the activated carbon is impregnated with a hydroxide to enhance adsorption performance.

17. The apparatus of claim 16 further comprising a second generator operatively connected to the engine to create additional electricity.

18. The apparatus of claim 16 wherein the steam boiler receives additional heat from another combustor.

19. The apparatus of claim 16, wherein the char has a carbon content of at least 65 wt. %.

20. The apparatus of claim 16, wherein the hydroxide comprises sodium hydroxide or potassium hydroxide.

* * * * *